US006768126B2

(12) United States Patent
Novak et al.

(10) Patent No.: US 6,768,126 B2
(45) Date of Patent: Jul. 27, 2004

(54) THERMAL IMAGE IDENTIFICATION SYSTEM

(76) Inventors: Harvey M. Novak, c/o Falcon Systems Engineering Corporation, 2111 Baldwin Ave., Suite 4, Crofton, MD (US) 21114; Chad Sample, c/o TVI Corporation, 7100 Holladay Tyler Rd., Glenn Dale, MD (US) 20769; Paul R. Baity, c/o Falcon Systems Engineering Corporation, 2111 Baldwin Ave., Suite 4, Crofton, MD (US) 21114; Russell J. Dominique, c/o Falcon Systems Engineering Corporation, 2111 Baldwin Ave., Suite 4, Crofton, MD (US) 21114

( * ) Notice: Subject to any disclaimer, the term of this patent is extended or adjusted under 35 U.S.C. 154(b) by 0 days.

(21) Appl. No.: 09/973,936

(22) Filed: Oct. 11, 2001

(65) Prior Publication Data

US 2002/0071020 A1 Jun. 13, 2002

Related U.S. Application Data

(60) Provisional application No. 60/239,100, filed on Oct. 11, 2000, and provisional application No. 60/273,518, filed on Mar. 7, 2001.

(51) Int. Cl.[7] ..... H05B 3/26

(52) U.S. Cl. ..... 250/504 R; 250/493.1; 250/495.1; 250/494.1; 250/750; 250/273; 250/348.1; 250/219; 250/345

(58) Field of Search ..... 250/504 R, 495.1; 750/493.1; 273/348.1; 219/345

(56) References Cited

U.S. PATENT DOCUMENTS

| | | | | |
|---|---|---|---|---|
| 4,250,398 A | | 2/1981 | Ellis et al. | 219/345 |
| 4,346,901 A | | 8/1982 | Booth | 273/408 |
| 4,724,356 A | | 2/1988 | Daehler | 313/522 |
| 4,792,142 A | | 12/1988 | Davies | 273/348.1 |
| 4,912,334 A | | 3/1990 | Anderson | 250/495.1 |
| 5,065,032 A | | 11/1991 | Prosser | 250/495.1 |
| 5,066,019 A | | 11/1991 | Dean et al. | 273/348.1 |
| 5,225,828 A | | 7/1993 | Walleston | 340/953 |
| 5,396,243 A | | 3/1995 | Jalink, Jr. et al. | 342/54 |
| 5,406,287 A | | 4/1995 | Pinkus | 342/13 |
| 5,751,006 A | | 5/1998 | Cooper | 250/495.1 |
| 5,804,829 A | | 9/1998 | Palmer | 250/504 H |
| 5,886,337 A | | 3/1999 | Rockstein et al. | 235/472 |
| 5,929,777 A | | 7/1999 | Reynolds | 340/825.49 |
| 5,969,369 A | | 10/1999 | Fogarty | 250/495.1 |
| 5,986,581 A | * | 11/1999 | Magdaleno, et al. | 340/953 |
| 6,069,557 A | | 5/2000 | Anglin, Jr. et al. | 340/321 |

FOREIGN PATENT DOCUMENTS

| | | |
|---|---|---|
| EP | 0156070 | 2/1985 |

* cited by examiner

*Primary Examiner*—John R. Lee
*Assistant Examiner*—Zia R. Hashmi
(74) *Attorney, Agent, or Firm*—Lowe Hauptman Gilman & Berner, LLP

(57) ABSTRACT

A thermal image identification system includes an infrared emitting element having a laminate, and a power source electrically communicable with the infrared emitting element. The laminate includes an infrared emitting layer having a first side and a second side, a cover layer associated with the first side, and a backing layer associated with the second side. The laminate may also include a first heat insulating layer between the infrared emitting layer and the cover layer, a second heat insulating layer between the infrared emitting layer and the backing layer, and an infrared reflective layer between the second heat insulating layer and the backing layer. A plurality of infrared emitting elements may be arranged contiguously for coordinated operation. The infrared emitting elements may be arranged in a one-dimensional or a two-dimensional array. A controller may be used to regulate at least one of an operating mode of the infrared elements, an illumination intensity of the infrared emitting elements, a temperature of the infrared emitting elements, and a voltage of the power source.

57 Claims, 9 Drawing Sheets

THERMAL IMAGE IDENTIFICATION SYSTEM

This application claims benefit of Ser. No. 60/239,100 filed Oct. 11, 2000 and claims benefit of Ser. No. 60/273,518 filed Mar. 7, 2001.

BACKGROUND OF THE INVENTION

1. Field of the Invention

The present invention relates to a thermal marker and, more particularly, to a thermal image identification system utilizing infrared energy.

2. Description of the Related Art

Thermal markers used for identification purposes are known in the art. Such markers have been used for various military and law enforcement applications. Conventional markers utilize a pouch containing chemicals that undergo an exothermic reaction on exposure to air to generate heat, and therefore infrared energy, for a period of time. The markers can be seen with special optical equipment, even under low visibility conditions.

There are a number of shortcomings associated with conventional thermal markers. First, they have a limited operational life. Because the heat is generated by a chemical reaction, the marker is no longer usable once the chemicals have been depleted. At the end of its operational life, the conventional thermal marker is discarded.

Further, use of conventional markers requires active participation by the wearer. A user must open a sealed pouch to expose the marker to air and initiate the heat-generating chemical reaction. For military and law enforcement personnel, this active initiation process may interfere with other activities necessary for self-preservation. Also, under extreme conditions, omission of this task could have catastrophic results.

Further, coordinated thermal signaling among a discrete group of individuals is difficult at best. Because remote activation is not feasible, the markers must be continuously activated, leading to excessive visibility to potential enemies and premature depletion of chemical fuel.

SUMMARY OF THE INVENTION

To overcome the drawbacks of the prior art and in accordance with the purpose of the invention, as embodied and broadly described herein, one aspect of the invention provides a thermal image identification system, including an infrared emitting element having a laminate, and a power source electrically communicable with the infrared emitting element. The laminate includes an infrared emitting layer having a first side and a second side, a cover layer associated with the first side, and a backing layer associated with the second side.

In another aspect, the invention provides an infrared emitting layer including a support having a first surface and a second surface, a first plurality of conductive elements disposed on the first surface, and a first layer of electrically conductive heating material disposed on the first plurality of conductive elements.

In another aspect, the invention provides an infrared emitting layer further including a second plurality of conductive elements disposed on the second surface, and a second layer of electrically conductive heating material disposed on the second plurality of conductive elements.

In a further aspect, the invention provides an infrared emitting layer including a support having a first surface and a second surface, and at least one resistive element disposed on the first surface.

According to a still further aspect, the invention provides a first heat insulating layer between the infrared emitting layer and the cover layer, a second heat insulating layer between the infrared emitting layer and the backing layer, and an infrared reflective layer between the second heat insulating layer and the backing layer.

In yet another aspect, the invention provides a plurality of infrared elements arranged contiguously for coordinated operation. According to this aspect of the invention, the infrared emitting elements may be arranged in a one-dimensional or a two-dimensional array.

In a further aspect, the invention provides a controller electrically communicating with the power source and with the plurality of infrared emitting elements. According to another aspect, the controller regulates at least one of an operating mode of the infrared elements, an illumination intensity of the infrared emitting elements, a temperature of the infrared emitting elements, and a voltage of the power source.

In a still further aspect, the invention provides a method of marking a target, the method including providing a thermal image identification system, including an infrared emitting element comprising a laminate, securing the infrared emitting element to a target, and activating the infrared emitting element to generate infrared radiation. The laminate includes an infrared emitting layer having a first side and a second side, a cover layer associated with the first side, a backing layer associated with the second side, and a power source electrically communicable with the infrared emitting element.

Additional advantages of the invention will be set forth in part in the description that follows, and in part will be obvious from the description, or may be learned by practice of the invention. The objects and advantages of the invention will be realized and attained by the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION OF THE INVENTION

Reference will now be made in detail to the present embodiments of the invention, examples of which are illustrated in the accompanying drawings. Wherever possible, the same reference numbers will be used throughout the drawings to refer to the same or like parts.

The thermal image identification system of the present invention provides a thermal marker that generates a unique infrared signature allowing identification and classification by a remote observer using an infrared imaging device. Applications include markers for personnel and equipment, and ground based markers.

Figure 1:
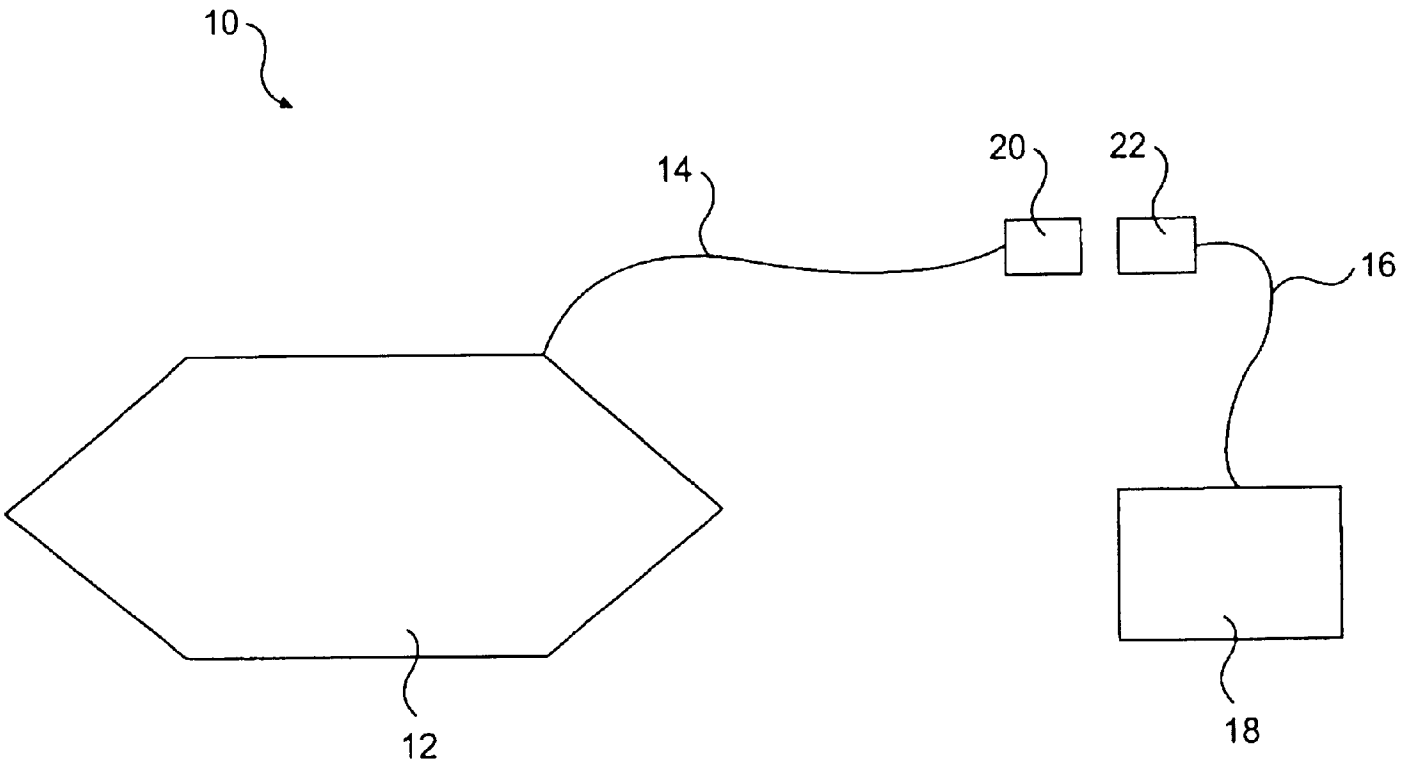
FIG. 1 is a schematic of an embodiment of the thermal image identification system of the present invention.

An embodiment of the thermal image identification system 10 will be described with reference to FIG. 1. As shown, the system includes an infrared emitting element 12 that may be connected to a power source 18 with cables 14, 16. The power source 18 may comprise one or more batteries. For larger applications, an electric generator may be used.

In this embodiment, the cables 14, 16 are provided with electrical connectors 20, 22, which allow a user to separate the infrared emitting element 12 from the power source 18. This arrangement allows the user to quickly replace the power source 18 when necessary, while continuing to use the same infrared emitting element 12. To ensure reliable operation in adverse environments, the system may utilize rugged, quick-disconnect type electrical connectors.

Figure 2:
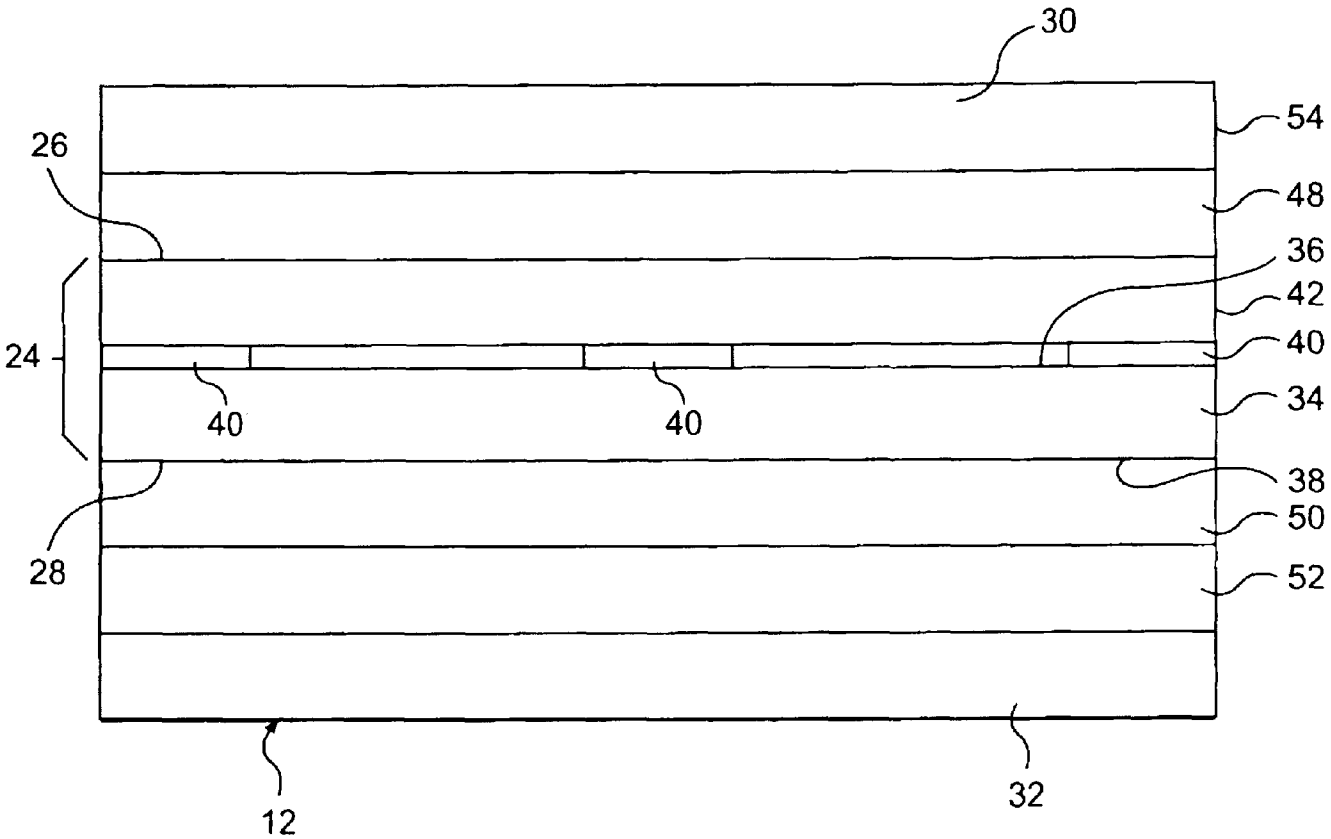
FIG. 2 is a schematic of an embodiment of the laminate of the infrared emitting element of the present invention.

The infrared emitting element 12 comprises a laminate, shown in FIG. 2, having an infrared emitting layer 24 with a first side 26 and a second side 28. There is a cover layer 30 associated with the first side 26 and a backing layer 32 associated with the second side 28.

The cover layer 30 comprises an infrared transparent material, such as polyethylene, and may be secured to the first side 26 of the infrared emitting layer 24 with non-conductive adhesive. This arrangement provides protection to the laminate, while allowing the emission of the infrared radiation generated by the infrared emitting layer 24.

The backing layer 32 comprises at least one of a chemical fastener, a magnetic fastener, and a mechanical fastener, and may be secured to the second side 28 of the infrared emitting layer 24 with non-conductive adhesive. Fasteners such as hook and loop fasteners, adhesives, and magnets have been used. Other fasteners may also be used.

The material of the backing layer 32 may be as flexible or as stiff as desired, depending on the end use of the thermal image identification system 10. The appropriate fastener and backing layer material may be chosen for a particular mounting application. Examples of mounting applications include the clothing and helmets of personnel, harnesses for canine applications, and surfaces of equipment and other support structures.

An embodiment of the laminate of the infrared emitting element 12 is shown in FIG. 2. In this embodiment, the infrared emitting layer 24 comprises a support 34 having a first surface 36 and a second surface 38. A first plurality of conductive elements 40 is disposed on the first surface 36, and a first layer of electrically conductive heating material 42 is disposed on the first plurality of conductive elements 40.

The conductive elements 40 may comprise copper electrodes, although other materials may also be used. In one embodiment, the conductive elements 40 and the support 34 are formed from a flexible printed circuit board. In a further embodiment, the support 34 comprises an insulating material. KAPTON has been used for this purpose, but other materials may be used.

In one embodiment, the electrically conductive heating material 42 comprises a plastic film, such as conductive thin film, an example of which is described in U.S. Pat. No. 4,422,646, incorporated herein by reference for a description of conductive thin films. Other materials may also be used. The first layer of electrically conductive heating material 42 may be secured to the first plurality of conductive elements 40 with conductive adhesive. A conductive adhesive such as IS8001-27 Conductive Double-coated Film/EC-2 Pressure Sensitive Adhesive has been used, but other adhesives may also be used.

In operation, infrared radiation is produced by the application of a voltage across the electrically conductive heating material 42 that causes current to flow through the material and produce heat. FIGS. 3*a*–3*d* show different arrangements of conductive elements 40 and electrically conductive heating material 42. The arrangements are selected to create uniform heating across the surface of the heating material 42, which produces uniform emission of infrared radiation.

Figure 3B:
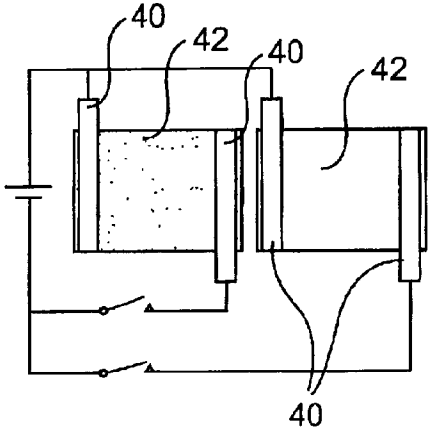
FIGS. 3*a*–3*d* are schematics of a thermal image identification system utilizing the infrared emitting element of FIG. 2.
Figure 3D:
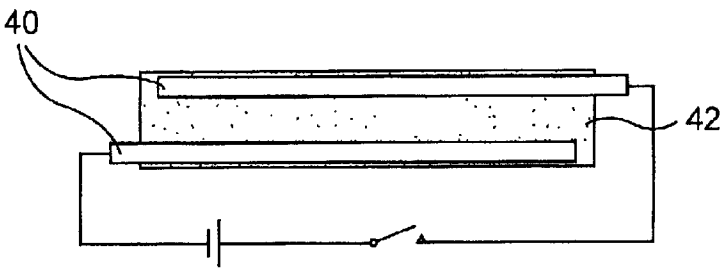
Figure 3A:
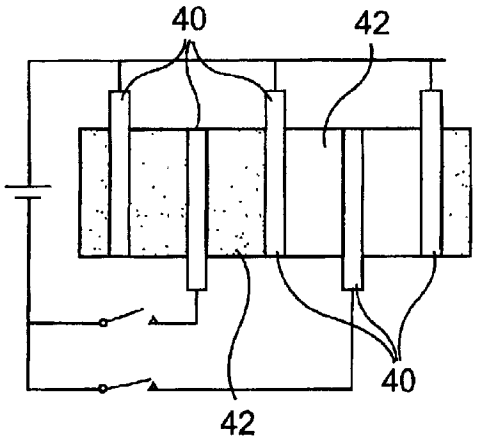
Figure 3C:
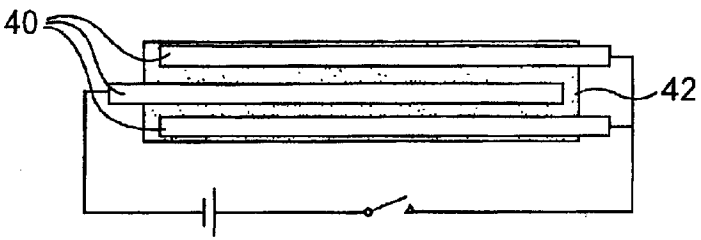

FIGS. 3*a* and 3*b* illustrate applications utilizing a plurality of infrared emitting elements 12. As shown, the individual elements may be activated independently. Systems utilizing multiple infrared emitting elements 12 will be discussed in more detail below.

Figure 4:
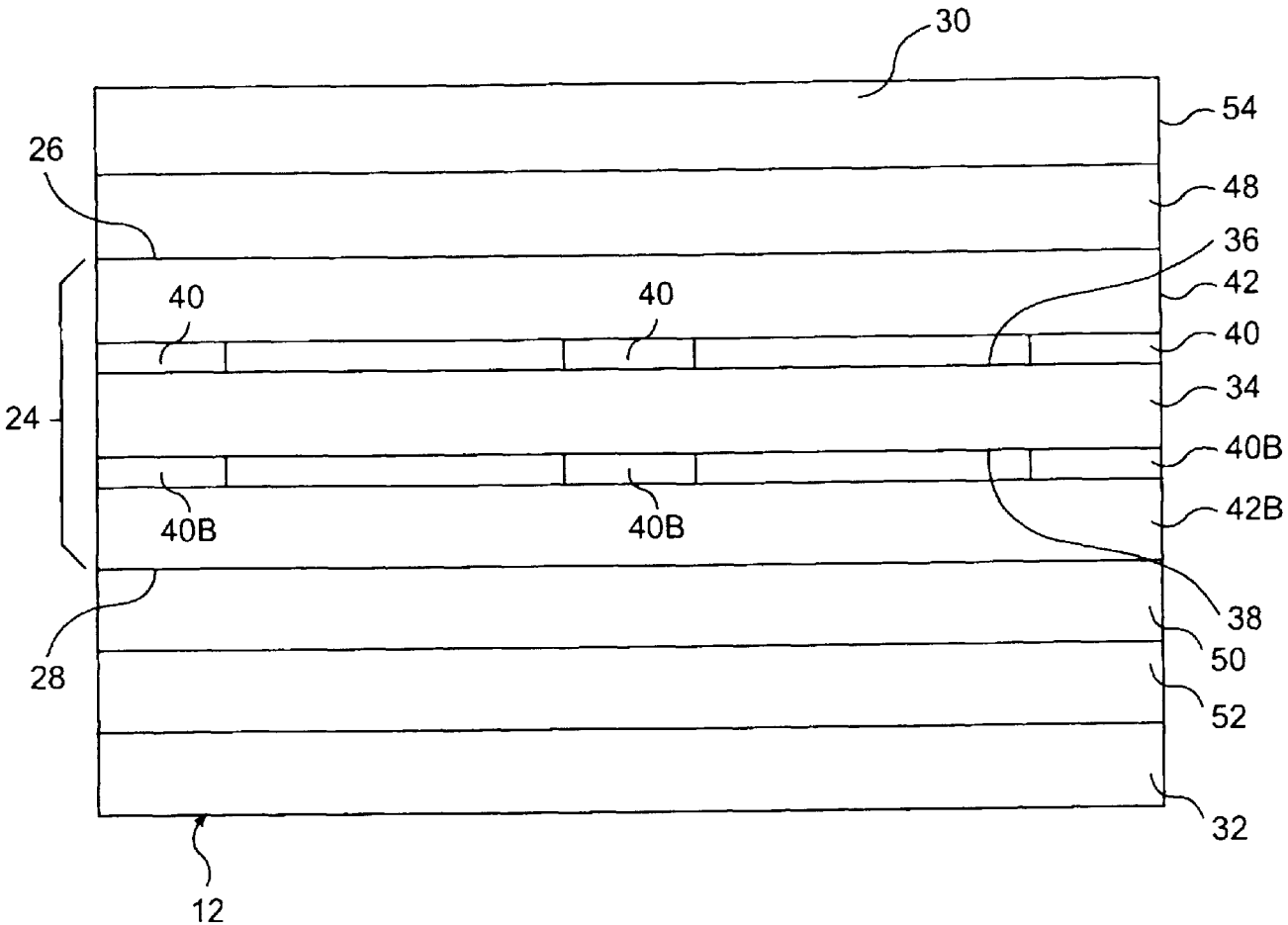
FIG. 4 is a schematic of another embodiment of the laminate of the infrared emitting element of the present invention.

Another embodiment of the laminate of the infrared emitting element 12 is shown in FIG. 4. In this embodiment, the infrared emitting layer 24 further comprises a second plurality of conductive elements 40B disposed on the second surface 38 of the support 34. A second layer of electrically conductive heating material 42B is disposed on the second plurality of conductive elements 40B.

As in the embodiment of FIG. 2, the conductive elements 40, 40B of this embodiment may comprise copper electrodes, although other materials may also be used. In one embodiment, the conductive elements 40, 40B and the support 34 are formed from a flexible printed circuit board. In a further embodiment, the support 34 comprises an insulating material. KAPTON has been used for this purpose, but other materials may be used.

As in the embodiment of FIG. 2, the electrically conductive heating material 42, 42B may comprise a plastic film, such as conductive thin film, although other materials may be used. The second layer of electrically conductive heating material 42B may be secured to the second plurality of conductive elements 40B with conductive adhesive. A conductive adhesive such as IS8001-27 Conductive Double-coated Film/EC-2 Pressure Sensitive Adhesive has been used, but other adhesives may also be used.

In the embodiments shown in FIGS. 2 and 4, the electrically conductive heating material 42, 42B may be formed in a shape comprising at least one of a geometric shape, a symbol, and an alphanumeric character. As an illustrative example, the infrared emitting element 12 shown in FIG. 1 is configured as a chevron.

Figure 5:
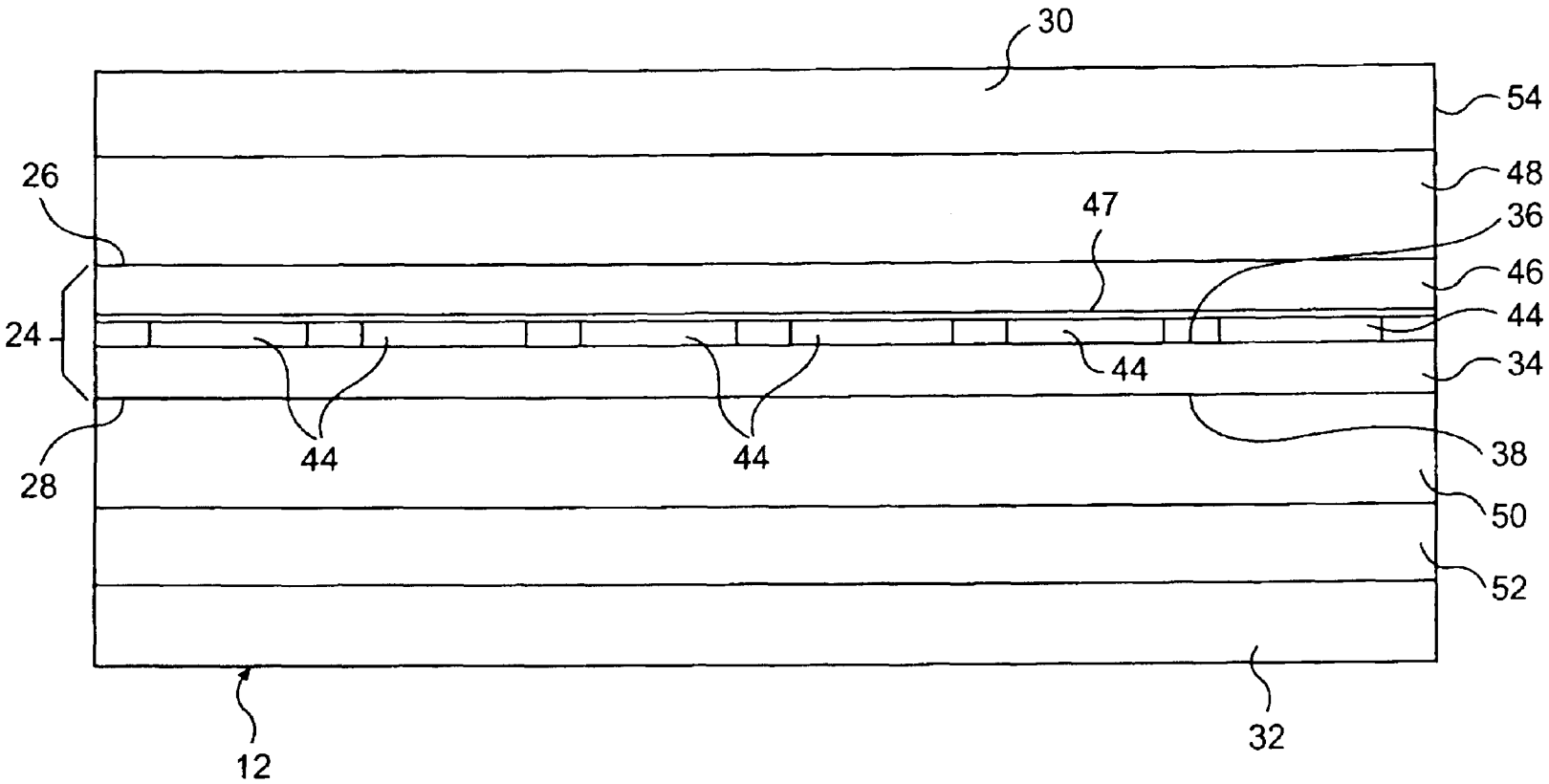
FIG. 5 is a schematic of another embodiment of the laminate of the infrared emitting element of the present invention.

Another embodiment of the laminate of the infrared emitting element 12 is shown in FIG. 5. In this embodiment, the infrared emitting layer 24 comprises a support 34 having a first surface 36 and a second surface 38, and at least one resistive element 44 disposed on the first surface 36.

The resistive element 44 may comprise a wire made from a resistive alloy, such as a nickel-chromium alloy. Alternatively, the resistive element 44 may comprise at least one of paste filled with metal particles, paste filled with carbon particles, ink filled with metal particles, ink filled with carbon particles, and metal film.

In one embodiment, the resistive element 44 and the support 34 are formed from a flexible printed circuit board. In a further embodiment, the support 34 comprises an insulating material. KAPTON has been used for this purpose, but other materials may be used.

Figure 6:
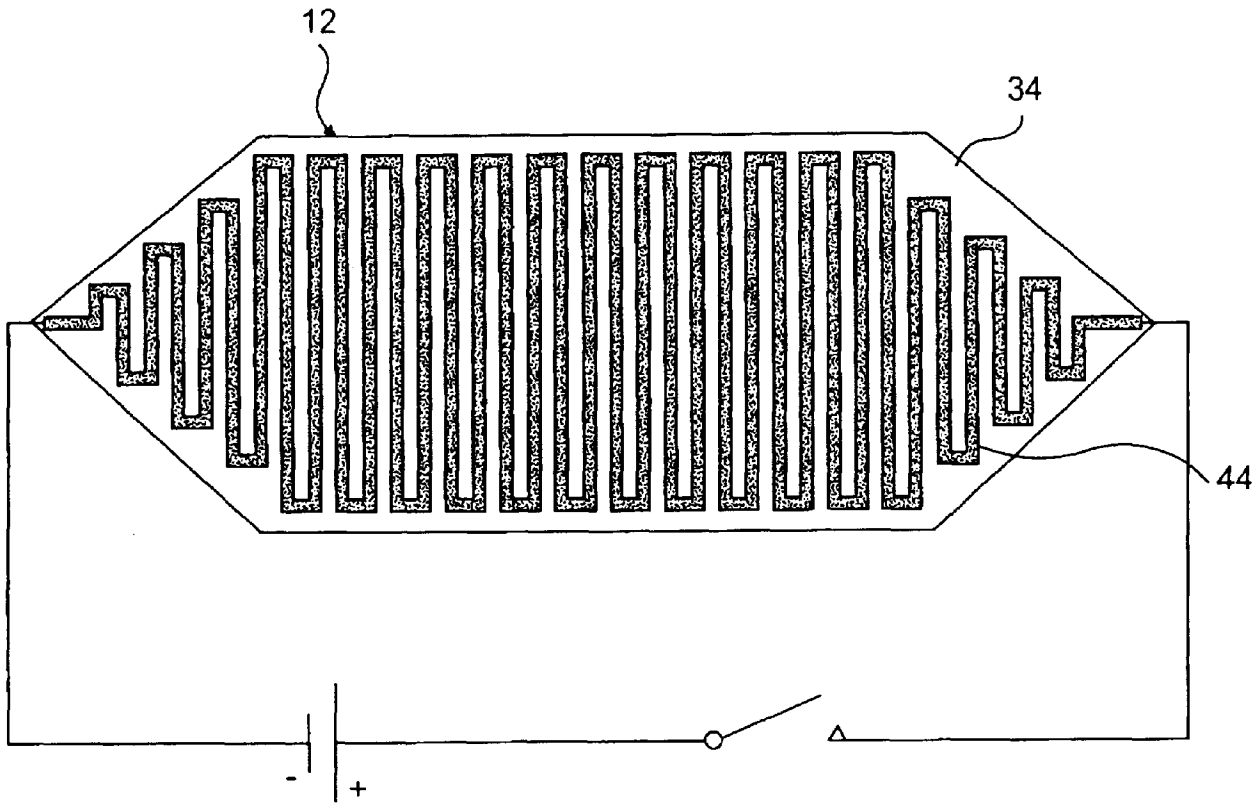
FIG. 6 is a schematic of a thermal image identification system utilizing the infrared emitting element of FIG. 5.

The resistive element 44 may be formed from a process involving material removal or material addition. For use as an infrared emitting element 12, the resistive element 44 is arranged in a serpentine pattern on the support 34, as shown in FIG. 6. The element 44, such as a wire, forms a circuit through which current flows and creates heat. The at least one resistive element 44 may be arranged on the support 34 to form a shape comprising at least one of a geometric shape, a symbol, and an alphanumeric character. As an illustrative example, the resistive element 44 shown in FIG. 6 is configured as a chevron.

The infrared emitting element 12 of this embodiment may further comprise a heat dispersion material 46 disposed on the at least one resistive element 44. The heat dispersion material 46 is electrically insulated from the at least one resistive element, such as with an insulating film 47. The heat dispersion material 46 may be secured to the at least one resistive element 44 with non-conductive adhesive. In one embodiment, the heat dispersion material 46 is formed from a material having a high heat conductance. In a further embodiment, the heat dispersion material 46 is formed from a material having a high infrared emissivity. The heat dispersion material 46 may comprise at least one of metal film, paint, and ink.

In operation, the heat dispersion material 46 is heated by the resistive element 44 and produces a uniformly heated surface and, therefore, uniform infrared radiation.

In one embodiment, the infrared radiation generated by the infrared emitting element 12 according to any of the above arrangements has a wavelength above 2 $\mu$m. In another embodiment, the infrared radiation has a wavelength in a range between 3 and 14 $\mu$m. In this wavelength range, the infrared radiation is invisible to the naked eye, as well as to image intensifiers and night vision equipment.

Alternative embodiments of the infrared emitting element 12 will now be described with reference to FIGS. 2, 4, and 5. In these illustrated embodiments, the laminate of the infrared emitting element 12 further comprises a first heat insulating layer 48 between the infrared emitting layer 24 and the cover layer 30. In a further embodiment, the laminate of the infrared emitting element 12 further comprises a second heat insulating layer 50 between the infrared emitting layer 24 and the backing layer 32. The first and second heat insulating layers 48, 50 comprise an infrared transparent material. A bubble-filled plastic film comprising polyethylene has been used, but other materials may be used.

In the embodiments illustrated in FIGS. 2, 4, and 5, the laminate of the infrared emitting element 12 further comprises an infrared reflective layer 52 between the second heat insulating layer 50 and the backing layer 32. In one embodiment, the infrared reflective layer 52 may comprise a metallized plastic film. In another embodiment, the infrared reflective layer 52 may comprise a metallic coating on the second heat insulating layer 50.

The insulating and reflective layers improve efficiency by minimizing heat loss and by directing the infrared radiation in one direction, namely, in the direction of the cover layer 30.

In the illustrated embodiments, the laminate of the infrared emitting element 12 further comprises a sealing layer 54 substantially covering edge portions of the infrared emitting element 12. The sealing layer 54 provides protection against moisture and other environmental elements.

Figure 7:
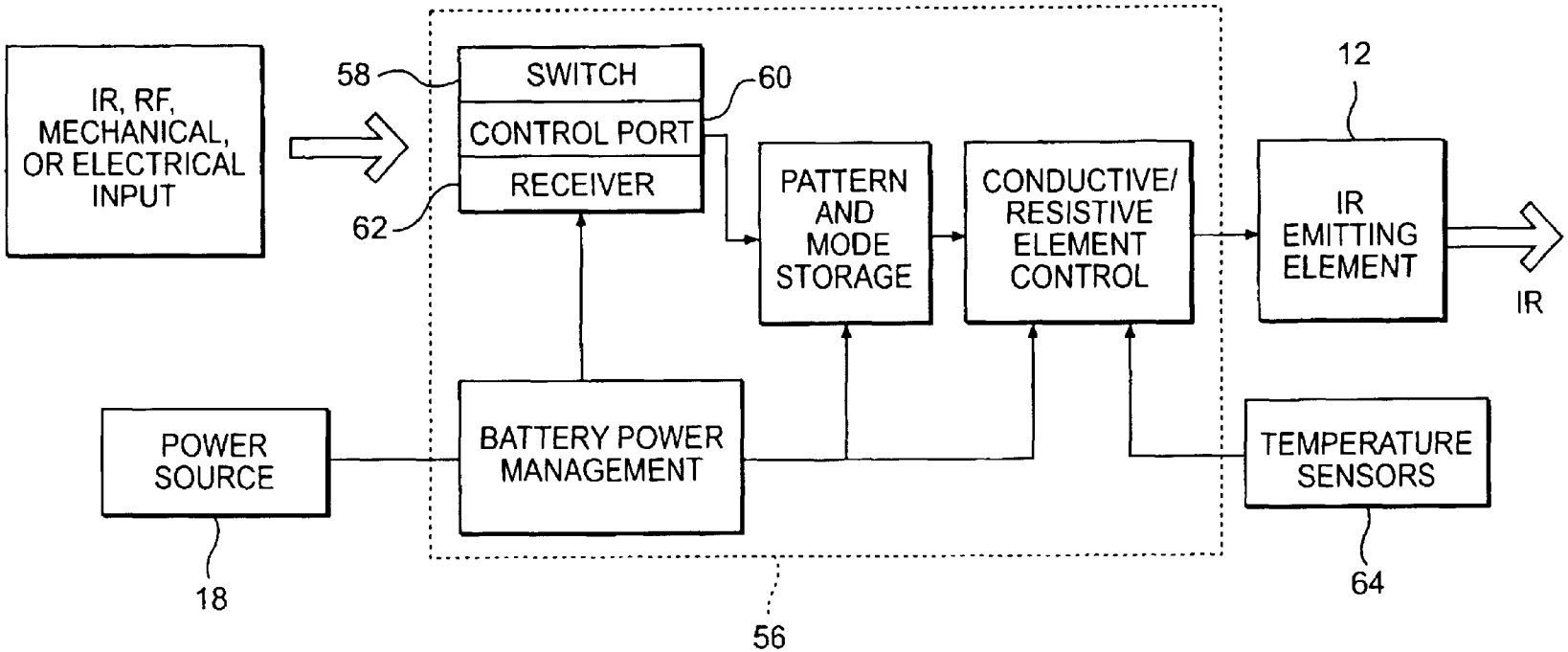
FIG. 7 is a schematic of an embodiment of the thermal image identification system of the present invention.

The system control will now be described with reference to FIG. 7. In the embodiment shown, the thermal image identification system 10 further comprises a controller 56 electrically communicating with the power source 18 and with the infrared emitting element 12. The controller 56 regulates at least one of an activation of the infrared emitting element 12, an illumination intensity of the infrared emitting element 12, a duration of a pulse of the infrared emitting element 12, a temperature of the infrared emitting element 12, and a voltage of the power source 18.

Thus, the controller 56 may be used to turn the infrared emitting element 12 on and off, to control its brightness and/or temperature, to operate it in a pulsing or flashing mode, and to regulate the system's consumption of power. In addition, multiple thermal image identification systems 10 can be made to operate synchronously, such as flashing simultaneously or emitting infrared radiation at a common intensity or in a common pattern.

In one embodiment, the thermal image identification system 10 further comprises a switch 58 electrically communicating with the controller 56, wherein the controller 56 generates a control signal in response to actuation of the switch 58. The switch 58 allows manual control over the operation of the system 10.

In another embodiment, the thermal image identification system 10 further comprises a control port 60 electrically communicating with the controller 56, wherein the controller 56 generates a control signal in response to an electric signal received through the control port 60. The control port 60 allows operating instructions to be provided, for example, by another computer through a temporary electrical connection, such as a cable.

In another embodiment, the thermal image identification system 10 further comprises a receiver 62 electrically communicating with the controller 56, wherein the controller 56 generates a control signal in response to an input signal received by the receiver 62. The receiver 62 comprises at least one of an infrared receiver and a radio frequency receiver. The receiver 62 allows operating instructions to be provided remotely, for example, using a computer, such as a personal data assistant, a laptop computer, radio transmitter, or other devices.

Thus, the control parameters described above may be selected or updated manually using the switch, electrically using the control port, or remotely using the receiver.

In another embodiment, the thermal image identification system 10 further comprises a temperature sensor 64 electrically communicating with the controller 56, wherein the controller 56 generates a control signal based on a measurement made by the temperature sensor 64. The system 10 according to this embodiment allows a user to adjust the temperature of the infrared emitting element 12. Further, such a system provides temperature stabilization, wherein a constant infrared emitting element temperature is achieved. Alternatively, a constant temperature differential above ambient temperature may be provided.

Figure 8:
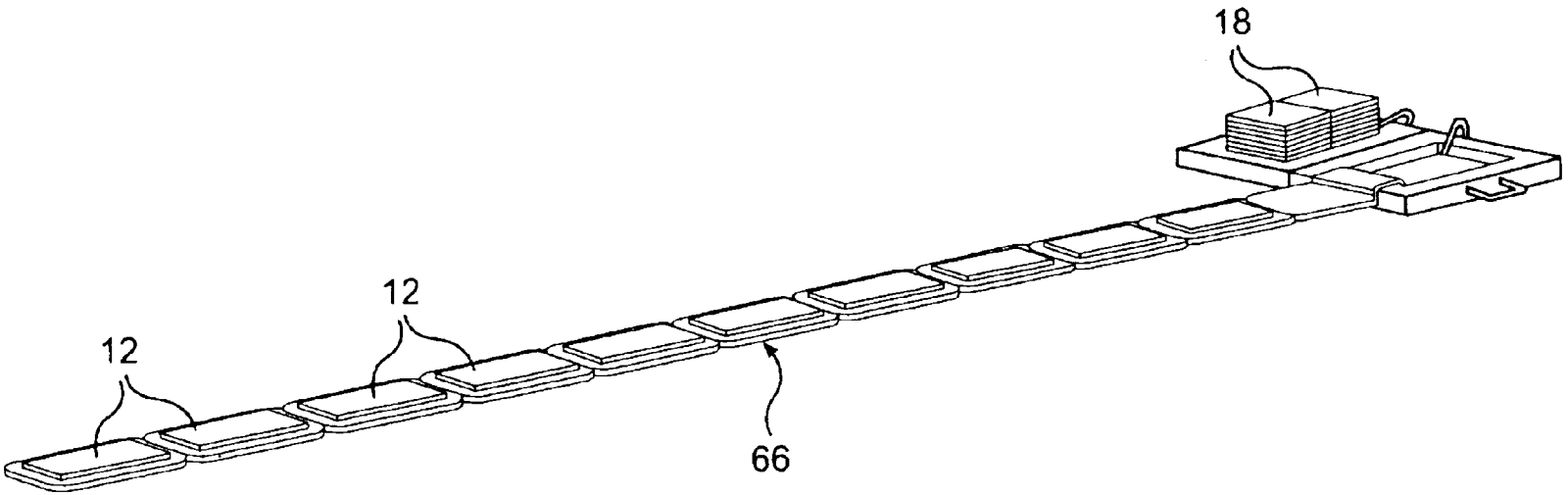
FIG. 8 is a perspective view of an application of the thermal image identification system of the present invention.

In another embodiment, the thermal image identification system 10 comprises a plurality of infrared emitting elements 12 arranged contiguously for coordinated operation. The infrared emitting elements 12 may be arranged in a one-dimensional array 66, as shown in FIG. 8. In one application, the embodiment of FIG. 8 has been used as a marker for an aircraft landing zone, although other uses are envisioned.

Figure 9B:
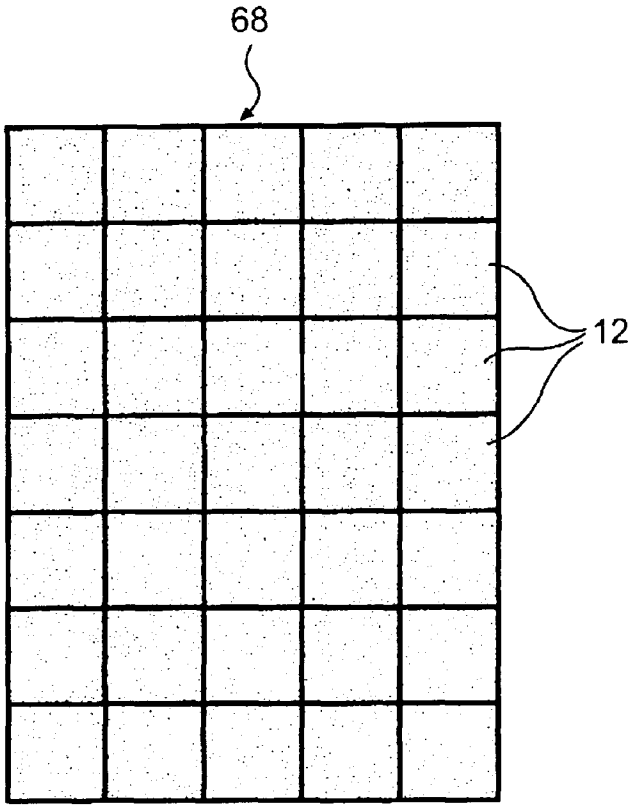
FIGS. 9*a* and 9*b* are schematics of other applications of the thermal image identification system of the present invention.
Figure 9A:
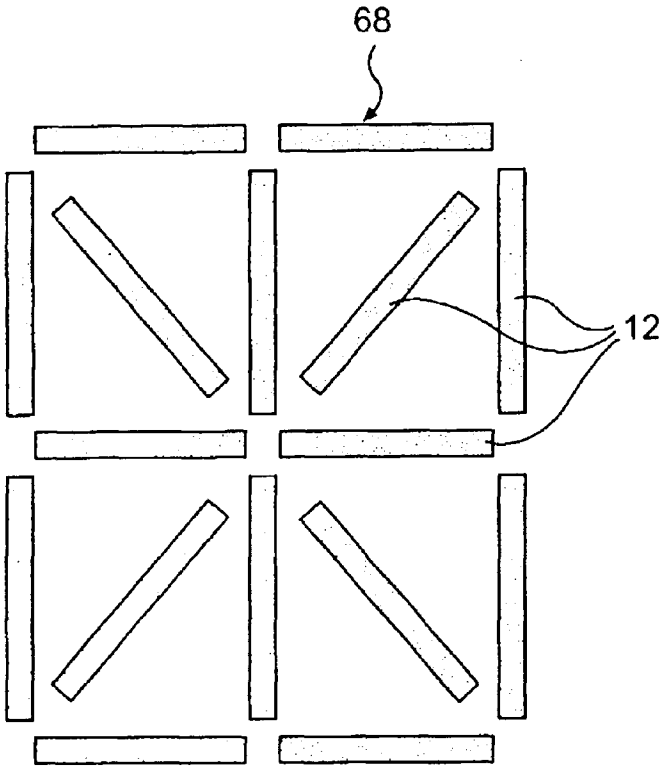

The infrared emitting elements 12 may also be arranged in a two-dimensional array 68, as shown in FIGS. 9*a* and 9*b*. In the embodiment of FIG. 9*a*, strip-shaped infrared emitting elements 12 are used, while in the embodiment of FIG. 9*b*, square-shaped elements 12 are used. It is noted that infrared emitting elements 12 of any shape can be used. Further, these elements can be grouped in an array of any shape.

As used herein, "array" denotes a grouping of plural elements, including elements spaced at equal and unequal intervals.

In one embodiment, the thermal image identification system 10 comprises a controller 56 electrically communicating with the power source 18 and with the plurality of infrared emitting elements 12. The controller 56 regulates at least one of an operating mode of the infrared emitting elements 12, an illumination intensity of the infrared emitting elements 12, a temperature of the infrared emitting elements 12, and a voltage of the power source 18.

In another embodiment, the operating mode comprises at least one of an on mode, an off mode, a pulsing mode, a sequential lighting mode, and a pattern display mode.

In a further embodiment, the pattern comprises at least one of a geometric shape, a symbol, and an alphanumeric character.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A thermal image identification system comprising:

an infrared emitting element comprising a laminate, the laminate comprising:

an infrared emitting layer having a first side and a second side;

a cover layer associated with the first side; and a backing layer associated with the second side; and a power source electrically communicable with the infrared emitting element;

wherein said thermal image identification system emits infrared radiation in substantially one direction.

2. The thermal image identification system of claim 1, wherein the infrared emitting layer comprises:

a support having a first surface and a second surface;

a first plurality of conductive elements disposed on the first surface; and a first layer of electrically conductive heating material disposed on the first plurality of conductive elements.

3. The thermal image identification system of claim 2, wherein the support and the first quality of conductive elements are formed from a flexible circuit board.

4. The thermal image identification system of claim 2, wherein the support comprises an insulating material.

5. The thermal image identification system of claim 2, wherein the first layer of electrically conductive heating is secured to the first plurality of conductive elements with a conductive adhesive.

6. The thermal image identification system of claim 2, wherein the first plurality of conductive elements comprises electrodes.

7. The thermal image identification system of claim 2, wherein the first layer of electrically conductive heating material is formed in a shape comprising at least one of a geometric shape, a symbol, and an alphanumeric character.

8. The thermal image identification system of claim 2, wherein the infrared emitting layer further comprises:

a second plurality of conductive elements disposed on the second surface; and a second layer of electrically conductive heating material disposed on the second plurality of conductive elements.

9. The thermal image identification system of claim 8, wherein the support, the first plurality of conductive elements, and the second plurality of conductive elements are formed from a flexible circuit board.

10. The thermal image identification system of claim 8, wherein the first and second layers of electrically conductive heating material are secured to the first and second pluralities of conductive elements, respectively, with a conductive adhesive.

11. The thermal image identification of claim 8, wherein the first and second pluralities of conductive elements comprise electrodes.

12. The thermal image identification system of claim 8, wherein the electrically conductive heating material comprises a plastic film.

13. The thermal image identification system of claim 1, wherein the infrared emitting layer comprises:

a support having a first surface and a second surface; and at least one resistive element disposed on the first surface.

14. The thermal image identification system of claim 13, further comprising a heat dispersion material disposed on the at least one resistive element.

15. The thermal image identification system of claim 14, wherein the heat dispersion material is electrically insulated from the at least one resistive element.

16. The thermal image identification of claim 15, wherein the heat dispersion material is secured to the at least one resistive element with a non-conductive adhesive.

17. The thermal image identification system of claim 14, wherein the heat dispersion material is formed from a material having a high heat conductance.

18. The thermal image identification system of claim 17, wherein the heat dispersion material is formed from a material having a high infrared emissivity.

19. The thermal image identification system of claim 18, wherein the heat dispersion material comprises of at least one of metal film, paint, and ink.

20. The thermal image identification system of claim 13, wherein the support and the at least one resistive element are formed from a flexible circuit board.

21. The thermal image identification system of claim 13, wherein the support comprises an insulating material.

22. The thermal image identification system of claim 13, wherein the at least one resistive element comprises a wire.

23. The thermal image identification system of claim 22, wherein the wire comprises a nickel-chromium alloy.

24. The thermal image identification system of claim 13, wherein the at least one resistive element comprises at least one of paste filled with metal particles, paste filled with carbon particles, ink filled with metal particles, ink filled with carbon particles, and metal film.

25. The thermal image identification system of claim 13, wherein the at least one resistive element is arranged on the support to form a shape comprising at least one of a geometric shape, a symbol, and an alphanumeric character.

26. The thermal image identification system of claim 1, wherein the cover layer is secured to the first side of the infrared emitting layer with non-conductive adhesive.

27. The thermal image identification system of claim 26, wherein the cover comprises an infrared transparent material.

28. The thermal image identification system of claim 1, wherein the backing layer is secured to the second side of the infrared emitting layer with non-conductive adhesive.

29. The thermal image identification system of claim 1, wherein the backing layer comprises at least one of a chemical fastener, a magnetic fastener, and a mechanical fastener.

30. The thermal image identification system of claim 1, further comprising a first heat insulating layer between the infrared emitting layer and the cover layer.

31. The thermal image identification system of claim 30, further comprising a second heat insulating layer between the infrared emitting layer and the backing layer.

32. The thermal image identification system of claim 31, wherein the first and second heat insulating layers comprise an infrared transparent material.

33. The thermal image identification system of claim 32, wherein the infrared transparent material comprises a bubble-filled plastic film.

34. The thermal image identification system of claim 1, further comprising an infrared reflective layer between the second heat insulating layer and the backing layer.

35. The thermal image identification system of claim 34, wherein the infrared reflective layer comprises a metallized plastic film.

36. The thermal image identification system of claim 34, wherein the infrared reflective layer comprises a metallic coating on the second heat insulating layer.

37. The thermal image identification system of claim 1, further comprising a sealing layer substantially covering edge portions of the infrared emitting element.

38. The thermal image identification system of claim 1, wherein the power source comprises at least one battery.

39. The thermal image identification system of claim 1, further comprising:

a first connector;

at least one first conductor electrically communicating the infrared omitting element with the first connector;

a second connector engageable with the first connector; and at least one second conductor electrically communicating the power source with the second connector.

40. The thermal image identification system of claim 1, further comprising a controller electrically communicating with the power source and with the infrared emitting element.

41. The thermal image identification system of claim 40, wherein the controller regulates at least one of an activation of the infrared emitting element, an illumination intensity of the infrared emitting element, a duration of a pulse of the infrared emitting element, a temperature of the infrared emitting element, and a voltage of the power source.

42. The thermal image identification system of claim 40, further comprising a switch electrically communicating with the controller, wherein the controller generates a control signal in response to actuation of the switch.

43. The thermal image identification system of claim 40, further comprising a control port electrically communicating with the controller, wherein the controller generates a control signal in response to an electric signal received through the control port.

44. The thermal image identification system of claim 40, further comprising a receiver electrically communicating with the controller, wherein the controller generates a control signal in response to an input signal received by the receiver.

45. The thermal image identification system of claim 44, wherein the receiver comprises at least one of an infrared receiver and a radio frequency receiver.

46. The thermal image identification system of claim 40, further comprising a temperature sensor electrically communicating with the controller, wherein the controller generates a control signal based on a measurement made by the temperature sensor.

47. The thermal image identification system of claim 1, further comprising a plurality of infrared emitting elements arranged contiguously for coordinated operation.

48. The thermal image identification system of claim 47, wherein the infrared emitting elements are arranged in a one-dimensional array.

49. The thermal image identification system of claim 47, wherein the infrared emitting elements are arranged in a two-dimensional array.

50. The thermal image identification system of claim 47, further comprising a controller electrically communicating with the power and with the plurality of infrared emitting elements.

51. The thermal image identification system of claim 50, wherein the controller regulates at least one of an operating mode of the infrared emitting elements, an illumination intensity of the infrared emitting elements, a temperature of the infrared emitting elements, and a voltage of the power source.

52. The thermal image identification system of claim 51, wherein the operating mode comprising at least one of an on mode, an off mode, a pulsing mode, a sequential lighting mode, and a pattern display mode.

53. The thermal image identification system of claim 52, wherein the pattern comprises at least one of a geometric shape, a symbol, and an alphanumeric character.

54. The thermal image identification system of claim 1, wherein communicating the power source with the infrared emitting element causes the infrared emitting element to generate infrared energy.

55. The thermal image identification system of claim 54, wherein the infrared energy has a wavelength above 2 $\mu$m.

56. The thermal image identification system of claim 55, wherein the infrared energy has a wavelength in a range between 3 and 14 $\mu$m.

57. A method of marking a target, the method comprising:

providing a thermal image identification system, comprising:

an infrared emitting element comprising a laminate, the laminate comprising: an infrared emitting element comprising a laminate, the laminate comprising:

an infrared emitting layer having a first side and a second side;

a cover layer associated with the first side; and a backing layer associated with the second side; and a power source electrically communicable with the infrared emitting element;

securing the second infrared emitting element to a target; and activating the infrared emitting element to generate infrared radiation and emit in substantially one direction.

* * * * *